US010053244B2

(12) United States Patent
Clark

(10) Patent No.: US 10,053,244 B2
(45) Date of Patent: Aug. 21, 2018

(54) PIPE, APPARATUS AND METHOD

(71) Applicant: ROLLS-ROYCE plc, London (GB)

(72) Inventor: Daniel Clark, Derby (GB)

(73) Assignee: ROLLS-ROYCE plc, London (GB)

( * ) Notice: Subject to any disclaimer, the term of this patent is extended or adjusted under 35 U.S.C. 154(b) by 82 days.

(21) Appl. No.: 15/049,453

(22) Filed: Feb. 22, 2016

(65) Prior Publication Data

US 2016/0244191 A1 Aug. 25, 2016

(30) Foreign Application Priority Data

Feb. 24, 2015 (GB) ..... 1503025.7

(51) Int. Cl.

| | |
|---|---|
| ***B65B 1/04*** | (2006.01) |
| ***B22F 3/00*** | (2006.01) |
| ***B22F 3/15*** | (2006.01) |
| *B65B 31/00* | (2006.01) |

(52) U.S. Cl.

CPC ..... *B65B 1/04* (2013.01); *B22F 3/003* (2013.01); *B22F 3/004* (2013.01); *B22F 3/15* (2013.01); *B65B 31/00* (2013.01)

(58) Field of Classification Search

CPC ... B65B 1/04; B65B 31/00; B22F 3/15; B22F 3/004; B22F 3/003

See application file for complete search history.

(56) References Cited

U.S. PATENT DOCUMENTS

| | | | | |
|---|---|---|---|---|
| 3,042,594 A | | 7/1962 | Hauth | |
| 4,348,212 A | * | 9/1982 | Rozmus | B03C 9/00 134/1 |
| 4,388,088 A | * | 6/1983 | Rozmus, Jr. | B03C 9/00 134/1 |
| 4,608,810 A | | 9/1986 | Bordini | |
| 4,861,546 A | | 8/1989 | Friedman | |
| 5,039,476 A | * | 8/1991 | Adachi | B22F 9/04 241/5 |
| 5,822,958 A | * | 10/1998 | Davis | B65B 39/00 137/240 |
| 5,849,244 A | | 12/1998 | Rhodes et al. | |
| 5,901,337 A | | 5/1999 | Rhodes et al. | |
| 6,478,041 B1 | * | 11/2002 | Stede | B65B 39/004 134/166 C |
| 7,163,121 B1 | | 1/2007 | Stouffer et al. | |
| 2003/0154689 A1 | | 8/2003 | Schlosser | |
| 2013/0126039 A1 | | 5/2013 | Berger et al. | |

FOREIGN PATENT DOCUMENTS

| | | |
|---|---|---|
| GB | 1 484 670 A | 9/1977 |
| SU | 927648 A1 | 5/1982 |

OTHER PUBLICATIONS

May 12, 2015 Search Report issued in British Patent Application No. GB1503025.7.

* cited by examiner

*Primary Examiner* — Nicolas A Arnett
(74) *Attorney, Agent, or Firm* — Oliff PLC

(57) ABSTRACT

The present invention provides a pipe for transferring powder material from a reservoir to a container e.g. prior to hot isostatic pressing. The pipe comprises a continuous outer wall and a concentric continuous inner wall enclosed within and spaced from the outer wall. The spacing between the inner and outer walls defines a flow channel extending from an inlet to an outlet. The radial cross sectional area of the outlet is greater than the cross sectional area of the inlet.

19 Claims, 1 Drawing Sheet

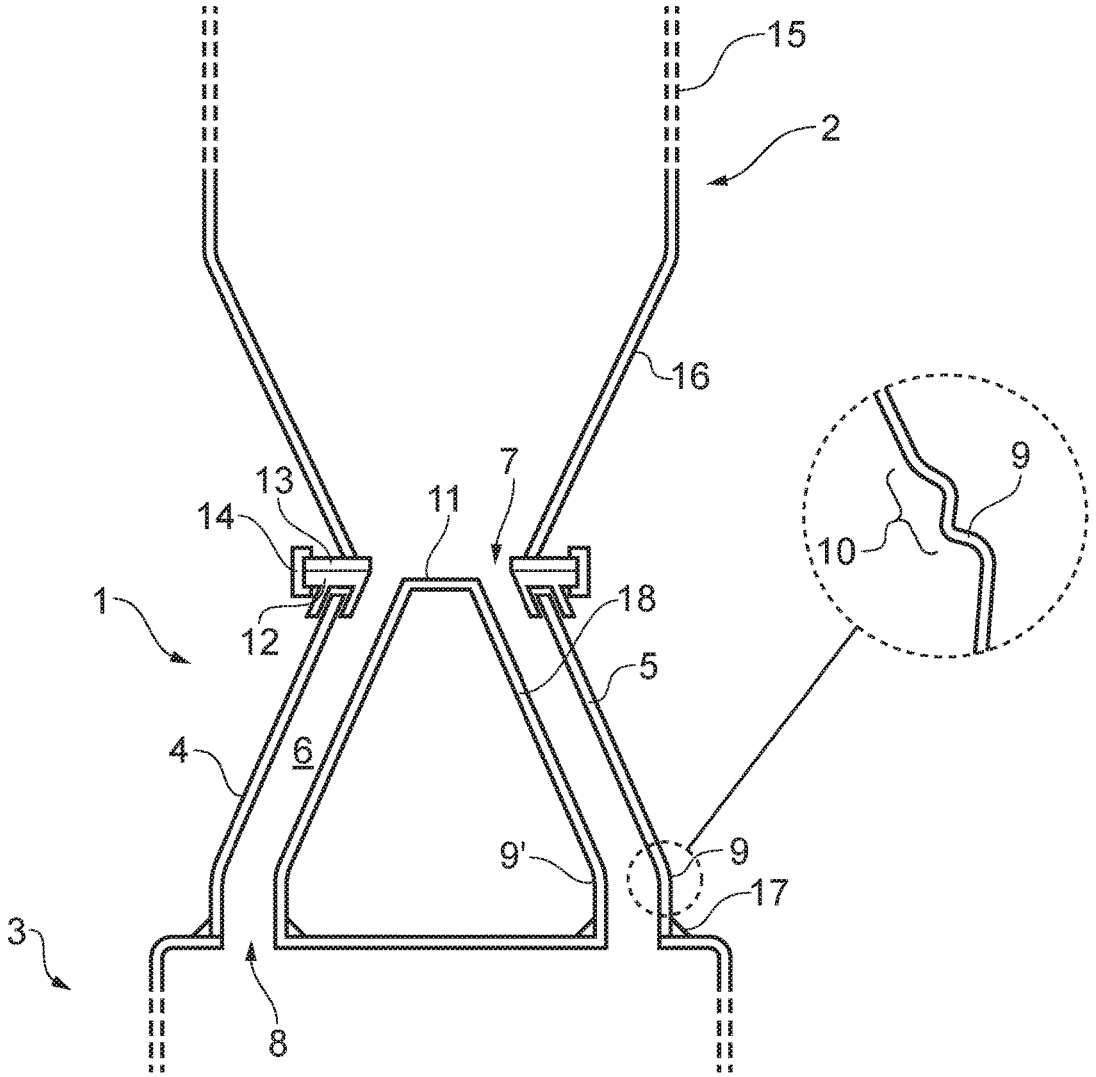
15
2
16
7
13
11
14
9
10
1
12
18
5
4
6
9'
9
17
3
8

PIPE, APPARATUS AND METHOD

FIELD OF THE INVENTION

The present invention relates to a pipe, apparatus and method for filling a container e.g. a canister for hot isostatic pressing with powder material.

BACKGROUND OF THE INVENTION

Hot isostatic pressing is a processing technique in which high isostatic pressure is applied to a powder material contained in a sealed and evacuated canister at a high temperature. During the hot isostatic pressing cycle, the canister collapses as a result of the high gas pressures and high temperatures applied and results in consolidation of the powder material to form the article.

The powder material and canister for containing the powder material are typically formed of a metal, metal alloy, ceramic or ceramic-metallic. The canister may be formed by machining or by welding sheet metal. It may be built up by galvanic or sprayed metal deposition on a wax or polymeric form which is subsequently removed.

The canister may be filled with the powder material using a pipe extending between a powder material reservoir/hopper and an opening in the canister (typically in the upper surface of the canister). In order to avoid clogging, bridging or "rat-holing" of the powder material, a large diameter pipe is required.

Prior to sealing the canister in preparation for hot isotactic pressing, it is known to apply a vacuum to the chamber to remove gas and/or moisture entrained within the powder material in order to minimise any voids in the finished article. Again, a large diameter pipe is desirable to facilitate evacuation.

One problem with using a large diameter filling/evacuation pipe is that the weld/crimp between the pipe and the canister is vulnerable to failing (e.g. fracturing) during hot isostatic pressing. Another problem is that large diameter pipes collapse in an unpredictable manner and thus the forces on the weld/crimp between the pipe and canister are unpredictable.

It is known to provide a number of smaller diameter pipes rather than a single larger diameter pipe but this complicates the manufacturing process as an increased number of welds/crimps need to be formed between the pipes and canister and the increased number of joins increases the number of possible failure locations during the hot isostatic pressing.

The pipes for powder material filling/gas evacuation are typically welded or crimped to the canister prior to filling/evacuation and are left in place during the hot isostatic pressing during which they collapse. The collapsed pipes are machined from the canister after hot isostatic pressing.

Accordingly the present invention seeks to provide a pipe, an apparatus and a method for filling/evacuating a container that reduces some of the problems associated with the known pipes/methods.

SUMMARY OF THE INVENTION

In a first aspect, the present invention provides a pipe for transferring powder material from a reservoir to a container, the pipe comprising:

a continuous outer wall; and a concentric continuous inner wall enclosed within and spaced from the outer wall, wherein the spacing between the inner and outer walls defines a flow channel extending from an inlet to an outlet, and wherein the cross sectional area of the outlet is greater than the cross sectional area of the inlet.

The present inventors have found that providing a pipe having two concentric walls defining a flow channel where the (radial) cross section (and volume) of the flow channel increases from the inlet to the outlet allows free flow of powder material from the inlet to the outlet with minimal clogging, bridging or rat-holing of the powder material. In addition, because the flow channel has a reduced radial dimension, the pipe collapses in a more predictable manner thus allowing for improved prediction of the stresses on the join between the pipe and the container which allows a reduction in the failure rate of the joins between the pipe and the container.

Optional features of the invention will now be set out. These are applicable singly or in any combination with any aspect of the invention.

In order to increase the radial cross sectional area (and volume) of the flow channel from the inlet to the outlet, the outer wall may extend/slope from the inlet to the outlet at an angle away from a central axis of the pipe. The inner wall may also extend/slope from the inlet to the outlet at an angle away from a central axis of the pipe. The inner and outer walls may be substantially equally spaced from one another along the flow channel.

In some embodiments, the outer wall and optionally the inner wall slopes at a substantially constant gradient away from the central axis at least at an upper portion proximal the inlet.

In some embodiments, the inner and outer walls are substantially truncated concentric conical walls. In these embodiments, the flow channel is an annular flow channel and the radial cross-sections of the inlet and outlet are both a respective circular annulus.

In some embodiments, the inner and outer walls may each have a quadrilateral radial cross sectional profile e.g. the radial cross sectional profile may be a square or rectangle. In this case, the inner and outer walls may be substantially truncated pyramidal walls (with a square or rectangular annulus for the inlet/outlet.)

In some embodiments, the inner and outer walls may each have a mandorla (almond-shaped) or truncated mandorla radial cross sectional profile. In this case, the inlet and outlet will each be a respective (truncated) mandorla annulus.

The inner and/or outer wall proximal the outlet may comprise a respective deflection. For example, the deflection may be such that the wall(s) extend(s) substantially parallel to the central axis of the pipe proximal the outlet.

In some embodiments, the deflection in the inner wall comprises a smooth, rolled deflection. This facilitates smooth flow of the powder material in the flow channel and minimises the opportunity for molten metal (weld splatter) ejected during the sealing of the pipe from reaching the powder material.

In some embodiments, the outer wall comprises at least one convolution proximal the outlet. The at least one convolution may be in addition to the deflection causing the outer wall to extend substantially axial to the outlet. This at least one convolution facilitates controlled collapse (e.g. in a concertina motion) of the outer wall e.g. by compression. This compression could be achieved by applying an axial force towards the outlet e.g. by forcing a reservoir connected at the inlet towards a container connected at the outlet.

In some embodiments, a convolution may contain a perforated, fibrous or porous barrier which can be pressed across the channel. This barrier can act to limit fine powder material being drawn into the vacuum pump during evacuation of the container.

In some embodiments, the outer wall is formed of roll-formed metal e.g. a low alloy steel. The outer wall thickness may be of the order of 0.5-0.6 mm.

In some embodiments, the inner wall is formed of spun metal e.g. a low alloy steel. The inner wall may be stiffer than the outer wall so that a contact seal can be formed between the outer wall and inner wall as the outer wall collapses against the inner wall.

In some embodiments, the inner wall comprises an upper portion which defines the inlet and a lower portion which defines the outlet. The two portions may be separable such that, after hot isostatic pressing, the upper portion may be removed intact e.g. by machining for re-use if desired.

In some embodiments, the outer wall comprises at least one connection element proximal the inlet for connection to the reservoir. The connection element may comprise an integral or separate flange for clamping to a corresponding flange on the reservoir.

The inner wall comprises a blind axial end proximal the inlet.

In a second aspect, the present invention provides an apparatus for filling a container with powder material, the apparatus comprising a pipe according to the first aspect and a reservoir for containing the powder material, the reservoir having an outlet for connected to the inlet of the pipe.

In some embodiments, the reservoir has an inlet for filling the reservoir with powder material and, optionally for connection to a vacuum source.

The reservoir may have a main body and a waist section of reduced dimensions between the main body and the pipe.

In a third aspect, the present invention provides an apparatus for filling a container with powder material, the apparatus comprising a pipe according to the first aspect and a container for containing the powder material, the container having an inlet in a upper surface connected to the outlet of the pipe.

The container may be a canister for use in hot isostatic pressing.

In some embodiments, the outer wall may be joined to the upper surface of the container by welding (e.g. laser, TIG, plasma or electron beam welding). The welding (e.g. the electron beam welding) may be carried out whilst the container is evacuated. The vacuum in the container acts to hold the two walls together. The welded join between the outer wall and the upper surface of the container may be heat treated i.e. tempered to improve the strength of the welded join.

In a fourth aspect, the present invention provides an apparatus for filling a container with powder material, the apparatus comprising a pipe according to the first aspect, a reservoir for containing the powder material prior to filling and a container for containing the powder material after filling, the reservoir having an outlet connected to the inlet of the pipe and the container having an inlet in a upper surface connected to the outlet of the pipe.

In some embodiments, the outer wall is joined at its axial end proximal the pipe outlet to the container upper surface e.g. by welding as described above.

In some embodiments, the outer wall is welded (e.g. laser, TIG or plasma welded) at its axial end proximal the pipe outlet to the container upper surface.

In some embodiments, the inner wall is joined at its axial end proximal the pipe outlet to the container upper surface.

In some embodiments, the inner wall is welded (e.g. laser, TIG or plasma welded) at its axial end proximal the pipe outlet to the container upper surface.

In some embodiments, the axial end(s) of the inner wall and/or outer wall proximal the pipe outlet is/are flush with the container upper surface i.e. the walls do not project into the interior of the container.

In some embodiments, the upper surface of the container may be a thin (e.g. 0.5-0.6 mm) membrane. This may help control deformation during hot isostatic pressing and may allow a powder material infill in constrained regions which maintaining tight container wall tolerances.

In a fifth aspect, the present invention provides a method of filling a container with powder material comprising:

providing a pipe according to the first aspect;

connecting the outer wall of the pipe proximal the inlet to a reservoir for containing powder material:

joining the outer wall of the pipe proximal the outlet to an upper surface of the container;

joining the inner wall of the pipe proximal the outlet to the upper surface of the container; and flowing powder material from the reservoir, through the inlet of the pipe to the outlet of the pipe and into the container.

In some embodiments, the method comprises subjecting the container to hot isostatic pressing after filling with powder material.

In some embodiments, the method comprises welding (e.g. laser, TIG or plasma welding) the outer wall proximal the outlet to the upper surface of the container.

In some embodiments, the method comprises welding (e.g. laser, TIG or plasma welding) the inner wall proximal the outlet to the upper surface of the container.

In some embodiments, the welded joins between the walls and the upper surface are heat-treated to improve their resistance to brittle fracture and to relieve weld-induced stresses.

In some embodiments, the method comprises evacuating gas from the container through the pipe prior to flowing powder material from the inlet of the pipe to the outlet and into the container.

In some embodiments, the method comprises evacuating gas from the container through the pipe after to flowing powder material from the inlet of the pipe to the outlet and into the container.

In some embodiments, the method further comprises sealing the flow channel by collapsing the outer wall against the inner wall e.g. by applying a force on the outer wall in a direction towards the container.

In some embodiments, the method comprises welding e.g. resistance welding around the seal between the outer wall and inner wall.

In some embodiments, the method comprises separating from the container an upper portion of the outer and inner walls above the seal proximal the reservoir.

In some embodiments, the method further comprises carrying out hot isostatic pressing on the container.

BRIEF DESCRIPTION OF THE DRAWINGS

Embodiments of the invention will now be described by way of example with reference to the accompanying drawings in which:

FIG. 1 shows a first embodiment of a pipe according to the first aspect of the present invention connected to a reservoir and a container.

DETAILED DESCRIPTION AND FURTHER OPTIONAL FEATURES OF THE INVENTION

FIG. 1 shows a pipe 1 for transferring powder material from a reservoir 2 to a container 3.

The pipe 1 comprises a continuous outer wall 4 and a concentric continuous inner wall 5 enclosed within and spaced from the outer wall 4. The spacing between the inner wall 5 and outer wall 4 defines a powder flow channel 6 extending from a pipe inlet 7 to a pipe outlet 8.

The inner wall 5 and outer wall 4 are truncated concentric conical walls. Both walls 4, 5 have a circular radial cross sectional profile with the diameter increasing linearly from the pipe inlet to the pipe outlet 8. Thus, both walls slope away from the central axis of the pipe at a constant gradient. As a result, powder flow channel 6 is an annular flow channel and the annular radial cross sectional area of the pipe outlet 8 is greater than the annular radial cross section of the pipe inlet 7.

The inner wall 5 and the outer wall 4 each comprise a respective deflection 9, 9' proximal the outlet. The deflections 9, 9' are such that the walls 4, 5 extend substantially parallel to the central axis of the pipe 1 proximal the pipe outlet 8.

The deflection 9' in the inner wall 5 comprises a smooth, rolled deflection which facilitates smooth flow of powder material in the flow channel and minimises splatter of material during welding of the pipe.

The outer wall comprises a number of convolutions 10 proximal the pipe outlet 8. The convolutions 10 are addition to the deflection 9. These convolutions facilitate controlled collapse (e.g. in a concertina motion) of the outer wall 5 e.g. by compression as described below.

The outer wall 5 is formed of roll-formed metal e.g. a low alloy steel. The outer wall thickness may be of the order of 0.5-0.6 mm.

The inner wall 4 is formed of spun metal e.g. a low alloy steel. The inner wall may be stiffer than the outer wall. The inner wall 4 comprises a blind axial end 11 proximal the pipe inlet 7.

The axial end of the outer wall 5 proximal the pipe inlet 7 is provided with a connection element 12 having a flange which is connected to a flange 13 at the outlet of the reservoir 2 using a clamp 14.

The reservoir has a main body 15 and a waist section 16 of reduced dimensions between the main body 15 and the pipe 1.

The container 3 is a canister for use in hot isostatic pressing. The container 3 has a thin (e.g. 0.5-0.6 mm) membrane as an upper surface 17 and the axial end of the outer wall 4 proximal the pipe outlet 8 is welded (e.g. laser, TIG or plasma welded) to the container upper surface 17. The axial end of the inner wall 5 proximal the pipe outlet 8 is also welded (e.g. laser, TIG or plasma welded) to the container upper surface 17. The axial ends of the inner wall 5 and outer wall 4 proximal the pipe outlet 8 are flush with the container upper surface 17 i.e. the walls 4, 5 do not project into the interior of the container 3.

In use, after connection of the pipe 1 between the reservoir 2 and the container 3 using the connection element 12 and welding respectively, the reservoir 2 is filled with powder material.

Then, the container is evacuated by attaching a vacuum source to the inlet (not shown) of the reservoir 2.

Powder is then allowed to flow from the reservoir 2 into the container 3 via the flow channel 6. The present inventors have found that providing a pipe having two concentric walls defining a flow channel where the (radial) cross-section (and volume) of the flow channel increases from the inlet to the outlet allows free flow of powder material from the inlet to the outlet with minimal clogging, bridging or rat-holing of the powder material.

The powder is filled to below the level of the convolutions 10 in the outer wall 4.

Once the container 3 is filled with powder material, a further evacuation step is carried out, again by connecting a vacuum source to the inlet of the reservoir 2. This is to eliminate any voids/moisture within the powder material.

After evacuation, the reservoir 2 is forced towards the container upper surface 17 along the central axis of the pipe 1. This causes the outer wall 4 to collapse in a concertina fashion against the inner wall 5 at in the area of the convolutions 10 thus closing the pipe 1. Resistance welding is used to seal the pipe where the collapsed outer wall 4 contacts the inner wall. An upper portion 18 of the inner wall 5 (above the seal with the outer wall 4) is subsequently machined from a lower portion of the inner wall 5 (below the deal with the outer wall 4). This upper portion 18 may be re-used in subsequent filling operations.

The method then comprises subjecting the container to hot isostatic pressing.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. An apparatus for filling a container with powder material, the apparatus comprising:

a pipe having a pipe inlet and a pipe outlet;

a reservoir for containing the powder material prior to filling;

and a container for containing the powder material after filling;

wherein the pipe comprises a continuous outer wall; and a concentric continuous inner wall enclosed within and spaced from the outer wall with both the outer wall and the inner wall joined to the container;

the reservoir having an outlet for connection to the pipe inlet and the container having an inlet in a upper surface for connection to the pipe outlet;

wherein the spacing between the inner and outer walls defines a flow channel extending from the pipe inlet to the pipe outlet, wherein the cross sectional area of the pipe outlet is greater than the cross sectional area of the pipe inlet, and wherein the container has an inlet in a upper surface for connection to the pipe outlet and the outer wall of the pipe is welded at its axial end proximal the pipe outlet to the container upper surface.

2. The apparatus according to claim 1, wherein the inner wall of the pipe is welded at its axial end proximal the pipe outlet to the container upper surface.

3. The apparatus according to claim 2, wherein the axial end of the inner wall proximal the pipe outlet is flush with the container upper surface.

4. The apparatus according to claim 1, wherein at least the outer wall of the pipe extends from the pipe inlet to the pipe outlet at an angle away from the central axis of the pipe.

5. The apparatus according to claim 4, wherein the inner and outer walls are substantially truncated conical walls and the flow channel is an annular flow channel.

6. The apparatus according to claim 1, wherein the inner and outer walls each have a quadrilateral radial cross sectional profile.

7. The apparatus according to claim 6, wherein the inner and outer walls are substantially truncated pyramidal walls.

8. The apparatus according to claim 1, wherein the inner and/or outer wall of the pipe proximal the pipe outlet comprises a respective deflection.

9. The apparatus according to claim 8, wherein the deflection on the inner wall is a smooth, rolled deflection.

10. The apparatus according to claim 1, wherein the outer wall comprises at least one convolution proximal the pipe outlet.

11. A method of filling a container with powder material with the apparatus according to claim 1, comprising:

flowing powder material from the reservoir, through the pipe inlet to the pipe outlet and into the container.

12. The method according to claim 11, wherein the inner and outer walls of the pipe are substantially truncated conical walls and the flow channel is an annular flow channel.

13. The method according to claim 12, further comprising subjecting the container to hot isostatic pressing after filling with powder material.

14. The method according to claim 13, wherein the method comprises evacuating gas from the container through the pipe prior to flowing powder material from the pipe inlet to the pipe outlet and into the container.

15. The method according to claim 13, wherein the method comprises evacuating gas from the container through the pipe after to flowing powder material from the pipe inlet to the pipe outlet and into the container.

16. The method according to claim 13, wherein the method comprises sealing the flow channel by collapsing the outer wall against the inner wall by applying a force on the outer wall in a direction towards the container.

17. The method according to claim 16, wherein the outer wall has at least one convolution proximal the pipe outlet that provide a controlled collapse of the outer wall when the force is applied to the outer wall.

18. The method according to claim 17, wherein the reservoir is separated from the container by dividing the pipe at a location between the convolution and the reservoir.

19. An apparatus for filling a container with powder material, the apparatus comprising:

a pipe having a pipe inlet and a pipe outlet;

a reservoir for containing the powder material prior to filling;

and a container for containing the powder material after filling;

wherein the pipe comprises a continuous outer wall; and a concentric continuous inner wall enclosed within and spaced from the outer wall with both the outer wall and the inner wall joined to the container;

the reservoir having an outlet for connection to the pipe inlet and the container having an inlet in a upper surface for connection to the pipe outlet;

wherein the spacing between the inner and outer walls defines a flow channel extending from the pipe inlet to the pipe outlet, wherein the cross sectional area of the pipe outlet is greater than the cross sectional area of the pipe inlet, and wherein the container has an inlet in a upper surface for connection to the pipe outlet and the outer wall of the pipe is joined at its axial end proximal the pipe outlet to the container upper surface.

* * * * *